US010415128B2

(12) United States Patent
Gane et al.

(10) Patent No.: US 10,415,128 B2
(45) **Date of Patent: *Sep. 17, 2019**

(54) METHOD FOR MANUFACTURING ANODIZED ALUMINUM ALLOY PARTS WITHOUT SURFACE DISCOLORATION

(71) Applicant: The Boeing Company, Chicago, IL (US)

(72) Inventors: David H. Gane, Seattle, WA (US); Ryan J. Glamm, Kent, WA (US); Gary R. Weber, Kent, WA (US); Ricole A. Johnson, Seattle, WA (US); Terry C. Tomt, Enumclaw, WA (US); Azzreal Pugh, Kent, WA (US); Daniel J. Kane, Mercer Island, WA (US); Peter D. Verge, Marysville, WA (US)

(73) Assignee: The Boeing Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/005,183

(22) Filed: Jun. 11, 2018

(65) Prior Publication Data

US 2018/0291488 A1 Oct. 11, 2018

Related U.S. Application Data

(62) Division of application No. 14/622,998, filed on Feb. 16, 2015, now Pat. No. 10,030,294.

(51) Int. Cl.
*C25D 11/16* (2006.01)
*C25D 11/02* (2006.01)
(Continued)

(52) U.S. Cl.
CPC ..... *C22F 1/04* (2013.01); *B22D 7/005* (2013.01); *C22C 21/00* (2013.01); *C22C 21/12* (2013.01);
(Continued)

(58) Field of Classification Search
CPC ..... C25D 11/04
See application file for complete search history.

(56) References Cited

U.S. PATENT DOCUMENTS 3,843,418 A * 10/1974 Oida et al. ..... C22C 21/08 148/415
4,906,534 A 3/1990 Yoichiro et al.
(Continued)

FOREIGN PATENT DOCUMENTS

CN 102816955 12/2012
CN 104131198 11/2014
(Continued)

OTHER PUBLICATIONS http://www.californiametal.com/Aluminum-2219_Sheet_Plate_Pipe_Tube_Rod_Bar.htm (Year: 2017).*
(Continued)

*Primary Examiner* — Brian W Cohen
(74) *Attorney, Agent, or Firm* — Walters & Wasylyna LLC

(57) ABSTRACT

A method for manufacturing a part including steps of (1) casting an ingot, (2) scalping the ingot to yield a scalped ingot, (3) homogenizing the scalped ingot to yield a homogenized ingot, (4) breakdown of the homogenized ingot to yield a slab, (5) rolling the slab to yield a rolled aluminum material, (6) annealing the rolled aluminum material to yield an aluminum starting material, (7) cold working the aluminum starting material to obtain an aluminum cold worked material, and (8) forming the part from the aluminum cold worked material.

20 Claims, 4 Drawing Sheets

(51) Int. Cl.

| | |
|---|---|
| ***C25D 11/04*** | (2006.01) |
| ***C22F 1/04*** | (2006.01) |
| ***C22C 21/00*** | (2006.01) |
| ***C22C 21/12*** | (2006.01) |
| ***C22F 1/057*** | (2006.01) |
| ***B22D 7/00*** | (2006.01) |

(52) U.S. Cl.
CPC ..... *C22F 1/057* (2013.01); *C25D 11/04* (2013.01); *C25D 11/16* (2013.01)

(56) References Cited

U.S. PATENT DOCUMENTS

| | | | | |
|---|---|---|---|---|
| 6,171,704 | B1 * | 1/2001 | Mosser | B64D 29/00 244/126 |
| 2014/0366999 | A1 * | 12/2014 | Kamat | B22D 21/04 148/551 |
| 2016/0168676 | A1 * | 6/2016 | Luckey, Jr. | C22F 1/00 148/695 |

FOREIGN PATENT DOCUMENTS

| | | |
|---|---|---|
| CN | 104213001 | 12/2014 |
| EP | 1733064 | 7/2010 |

OTHER PUBLICATIONS

Rolling Aluminum: From the Mine through the Mill. (Year: 2008).*
Brush Wellman Alloy Products; "Strain Hardening & Strength" (Year: 2010).*
State Intellectual Property Office of China, "First Notification of Office Action," with English translation, App. No. 201610082171.2 (dated Jun. 4, 2018).
China National Intellectual Property Administration, Office Action, App. No. 201610082171.2 (dated May 8, 2019).
Canadian Intellectual Property Office, Office Action, App. No. 2,917,908 (dated Feb. 26, 2019).

* cited by examiner

METHOD FOR MANUFACTURING ANODIZED ALUMINUM ALLOY PARTS WITHOUT SURFACE DISCOLORATION

PRIORITY

This application is a divisional of U.S. Ser. No. 14/622,998 filed on Feb. 16, 2015.

FIELD

This application relates to aluminum alloys and, more particularly, to forming parts from aluminum alloys and, even more particularly, to processes for reducing (if not eliminating) surface discoloration of parts formed from aluminum alloy sheets and plates.

BACKGROUND

Aircraft engines are typically spaced from the fuselage and, therefore, are housed in a nacelle. A typical nacelle is constructed as an aerodynamic housing having a forward portion, commonly referred to as a nose cowl, which defines an inlet into the nacelle. A ring-like structure, commonly referred to as a lipskin, is typically connected to the nose cowl of the nacelle.

Aircraft lipskins are commonly manufactured from aluminum alloys. The aluminum alloy starting material is typically received from an aluminum supplier in plate form and in an annealed state. Then, the aluminum alloy plate is cut into a blank having the desired silhouette, and the blank is then formed into the desired lipskin shape, such as by die-stamping the blank in a press or by spin-forming the blank. After heat treating, final sizing and aging, the surface of the lipskin is typically machined to the desired surface finish and the lipskin is chemically treated and anodized to yield a finished part.

When certain aluminum alloys, such as 2219 aluminum alloy, are used to form lipskins, discoloration is often visible in the final anodized part. For example, the discoloration can appear as visible lines of discoloration on the surface of the part. The discoloration typically presents itself after the forming (e.g., spin-forming) step, but becomes much more acute after anodizing.

Attempts have been made to obscure such surface discoloration, such as by applying a rough, non-directional surface finish prior to anodizing. For example, a surface roughness (Ra) of 125 microinches has been used to obscure such discoloration. However, such a high surface roughness generally will not satisfy stringent surface quality requirements aimed at improving aerodynamic performance.

Accordingly, those skilled in the art continue with research and development efforts if the field of aluminum alloy forming.

SUMMARY

In one embodiment, the disclosed method for manufacturing a part may include the steps of (1) providing an aluminum starting material, wherein the aluminum starting material is in an anneal temper, (2) cold working the aluminum starting material to obtain an aluminum cold worked material, and (3) forming the part from the aluminum cold worked material.

In another embodiment, the disclosed method for manufacturing a part may include the steps of (1) casting an ingot, (2) scalping the ingot to yield a scalped ingot, (3) homogenizing the scalped ingot to yield a homogenized ingot, (4) breakdown of the homogenized ingot to yield a slab, (5) rolling the slab to yield a rolled aluminum material, (6) annealing the rolled aluminum material to yield an aluminum starting material, (7) cold working the aluminum starting material to obtain an aluminum cold worked material, and (8) forming the part from the aluminum cold worked material.

In yet another embodiment, the disclosed method for manufacturing a part may include the steps of (1) casting an ingot, (2) scalping the ingot to yield a scalped ingot, (3) homogenizing the scalped ingot to yield a homogenized ingot, (4) breakdown of the homogenized ingot to yield a slab, (5) rolling the slab to yield a rolled aluminum material, (6) annealing the rolled aluminum material to yield an aluminum starting material, (7) cold working the aluminum starting material to obtain an aluminum cold worked material, (8) forming the part from the aluminum cold worked material, (9) solution heat treating the part to obtain a heat treated part, (10) final sizing of the heat treated part to obtain a sized part, (11) inspecting the sized part, (12) aging the sized part to obtain an aged part, and (13) anodizing the aged part.

Other embodiments of the disclosed method for manufacturing anodized aluminum alloy parts without surface discoloration will become apparent from the following detailed description, the accompanying drawings and the appended claims.

DETAILED DESCRIPTION

It has now been discovered that the discoloration that occurs when forming a part from an aluminum alloy, such as 2219 aluminum alloy, may be reduced or eliminated by uniformly applying at least a minimum amount of cold work to the aluminum alloy prior to forming, rather than forming the part while the aluminum alloy is in the anneal (O) temper. Without being limited to any particular theory, it is believed that the discoloration occurs as a result of localized recrystallization due to non-uniform work/energy applied during anneal (O) temper forming. By uniformly applying cold work to the aluminum alloy prior to forming, uniform recrystallization of the grain may occur. Therefore, when the aluminum alloy is later subjected to a forming step, the entire part assumes the uniform color associated with recrystallization.

Figure 1:
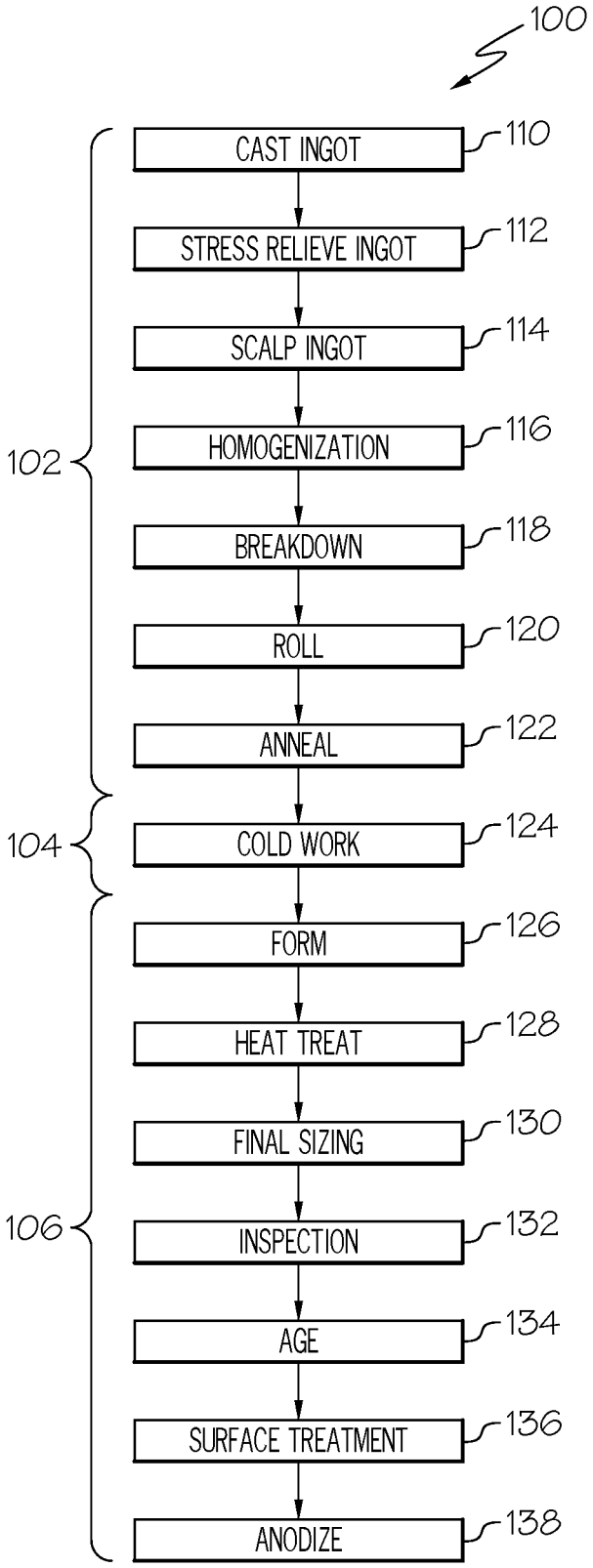
FIG. 1 is a flow diagram depicting one embodiment of the disclosed method for manufacturing an aluminum alloy part.

Referring to FIG. 1, disclosed is one embodiment of a method, generally designated 100, for manufacturing an aluminum alloy part. In general, the method 100 may include a starting material preparation phase 102, a cold working phase 104, and a forming/finishing phase 106. As noted above, and without being limited to any particular theory, introducing a cold working phase 104 between the traditional starting material preparation phase 102 and the traditional forming/finishing phase 106 may substantially reduce (if not fully eliminate) discoloration in the finished part.

Various parts may be manufactured using the disclosed method 100. As one general, non-limiting example, aerospace parts may be manufactured using the disclosed method 100. As one specific, non-limiting example, aircraft lipskins may be manufactured using the disclosed method 100. The resulting lipskins may be substantially free of visible surface discoloration, yet may be finished to present a substantially smooth surface (e.g., a surface roughness (Ra) of 40 microinches), thereby satisfying natural laminar flow (NLF) requirements. As another general, non-limiting example, automotive parts may be manufactured using the disclosed method 100.

The starting material preparation phase 102 may provide an aluminum starting material, which may be in the anneal (O) temper. For example, the aluminum starting material may be in plate form. The plate of aluminum starting material may be rolled to a desired gauge, which may be a gauge that is slightly thicker than the gauge desired for the forming/finishing phase 106.

The aluminum starting material may be aluminum or an aluminum alloy. As one general, non-limiting example, the aluminum starting material may be a 2xxx series aluminum alloys. As one specific, non-limiting example, the aluminum starting material may be 2219 aluminum alloy, which is predominantly comprised of aluminum and copper, but may also include iron, magnesium, manganese, silicon, titanium, vanadium, zinc and zirconium.

As shown in FIG. 1, the starting material preparation phase 102 may begin at Block 110 with the step of casting an ingot. To yield an ingot having the desired composition, a molten mass may be prepared by combining and heating appropriate quantities of primary aluminum, scrap and master alloys. As an example, the ingot may be formed using a direct-chill casting process, wherein the molten mass is poured into a mold and then the mold is quenched in a water bath. Other casting techniques may also be used and will not result in a departure from the scope of the present disclosure.

After solidification, the ingot may undergo stress relieving, as shown at Block 112. The stress relieving step (Block 112) may include holding the ingot at a moderate temperature to relieve internal stresses within the ingot. For example, when the ingot is formed from 2219 aluminum alloy, the stress relieving step (Block 112) may include holding the ingot at a moderate temperature, such as about 600° F. to about 1000° F., for at least 6 hours.

At Block 114, the ingot may undergo a scalping step. The scalping step may remove the outer surfaces of the ingot.

At Block 116, the scalped ingot may undergo homogenization. The homogenization step (Block 116) may homogenize solidification-induced chemical microsegregation. For example, when the ingot is formed from 2219 aluminum alloy, the homogenization step (Block 116) may include holding the ingot at a moderate temperature, such as about 700° F. to about 1100° F., for about 8 to about 24 hours.

At Block 118, the homogenized ingot may undergo breakdown to provide a slab having a reduced thickness. For example, the homogenized ingot may undergo breakdown by way of rough roll reducing at elevated temperatures. For example, when the ingot is formed from 2219 aluminum alloy, the breakdown step (Block 118) may be performed at an elevated temperature, such as about 600° F. to about 1000° F.

A further reduction in thickness may be achieved by rolling to gauge, as shown at Block 120. The rolling step (Block 120) may be performed at an elevated temperature and may reduce the thickness of the cast aluminum material to the desired gauge. For example, when the ingot is formed from 2219 aluminum alloy, the rolling step (Block 120) may be performed at a temperature ranging from about 500° F. to about 1000° F. The rolling step (Block 120) may provide a rolled aluminum material in the "as fabricated" (F) temper.

At Block 122, the rolled aluminum material may be annealed to provide the aluminum starting material in the anneal (O) temper. The annealing step (Block 122) may include a long hold at an elevated temperature to relieve internal stress and coarsen soluble secondary phase particles. For example, when the ingot is formed from 2219 aluminum alloy, the annealing step (Block 122) may include holding the rolled aluminum material at an elevated temperature, such as about 400° F. to about 700° F., for about 8 to about 24 hours.

While the starting material preparation phase 102 is presented as a series of steps 110, 112, 114, 116, 118, 120, 122, additional (or fewer) steps may also be included in the starting material preparation phase 102 without departing from the scope of the present disclosure. Furthermore, while the steps 110, 112, 114, 116, 118, 120, 122 of the starting material preparation phase 102 are presented in a particular succession order, some steps may be performed simultaneously with other steps and/or in a different order, without departing from the scope of the present disclosure.

Thus, the starting material preparation phase 102 may provide an aluminum starting material, which may be in the anneal (O) temper. As noted herein, forming a part from such an aluminum starting material may result in discoloration. Therefore, the disclosed method 100 incorporates the disclosed cold working phase 104 prior to the forming/finishing phase 106.

The cold working phase 104 of the disclosed method 100 may introduce to the aluminum starting material a substantially uniform strain, thereby providing an aluminum cold worked material. The magnitude of the strain may be sufficiently high to effect substantially uniform recrystallization across the aluminum starting material.

Still referring to FIG. 1, the cold working phase 104 may include the step of cold working the aluminum starting material, as shown in Block 124, to provide the aluminum cold worked material. As used herein, "cold work" and "cold working" of the aluminum starting material refers to plastic deformation performed at a low temperature relative to the melting point of the aluminum starting material (i.e., at a "cold working temperature"). Cold working may result in the accumulation of stain energy in the individual grains, which may drive grain growth and recrystallization.

The upper limit of the cold working temperature range may be a function of, among other things, the composition of the aluminum starting material, the rate of deformation and the amount of deformation. In one manifestation, the cold working temperature may be at most 50 percent of the melting point (on an absolute scale (e.g., kelvin)) of the aluminum starting material. In another manifestation, the cold working temperature may be at most about 300° F. In another manifestation, the cold working temperature may be at most about 200° F. In another manifestation, the cold working temperature may be at most about 100° F. In yet another manifestation, the cold working temperature may be ambient temperature.

Figure 2:
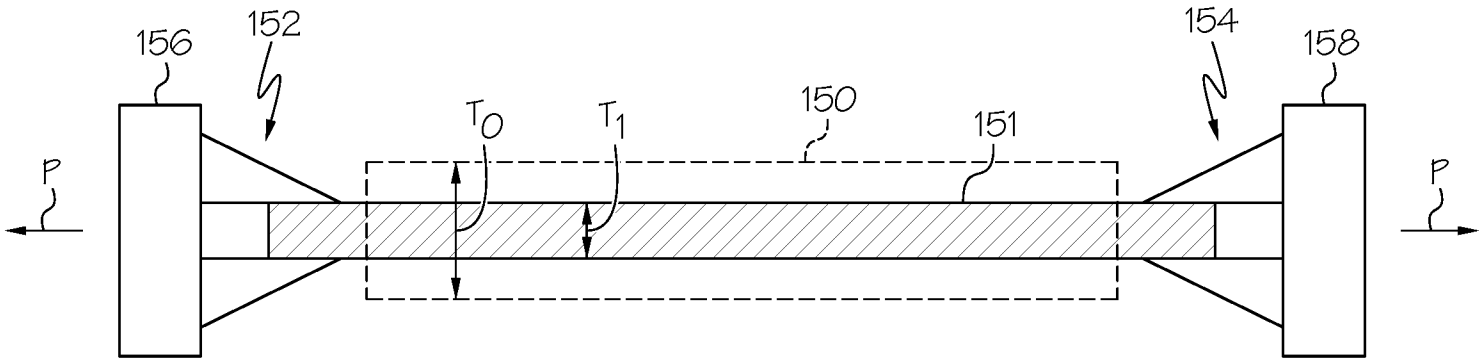
FIG. 2 is a schematic representation of one example of a cold working step useful in the method shown in FIG. 1.

In one implementation, the cold working step (Block 124 in FIG. 1) may be performed by stretching the aluminum starting material 150 to provide the aluminum cold worked material 151, as shown in FIG. 2. For example, the aluminum starting material 150 may be grasped at opposed ends 152, 154 by clamps 156, 158. The clamps 156, 158 may apply a pulling force (arrows P) to the aluminum starting material 150, thereby causing a reduction in gauge (from an initial thickness $T_0$ to a final thickness $T_1$).

Figure 3:
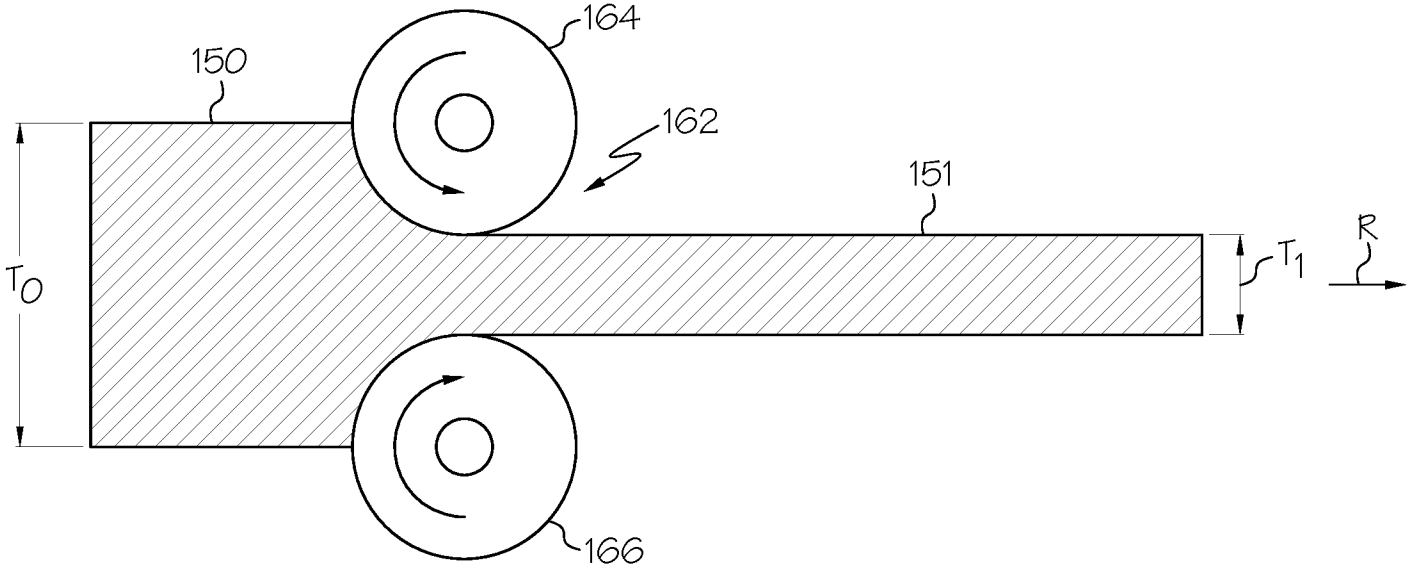
FIG. 3 is a schematic representation of another example of a cold working step useful in the method shown in FIG. 1.

In another implementation, the cold working step (Block 124 in FIG. 1) may be performed by rolling the aluminum starting material 150 to provide the aluminum cold worked material 151, as shown in FIG. 3. For example, the aluminum starting material 150 may move in the direction shown by arrow R and may pass through the nip 162 defined by two rollers 164, 166. The rollers 164, 166 may cause a reduction in gauge (from an initial thickness $T_0$ to a final thickness $T_1$).

Referring back to FIG. 1, various other cold working processes or combinations of processes may also be used in the cold working step (Block 124) of the disclosed method 100. Non-limiting examples of other cold working processes that may be used include drawing, pressing, spinning, extruding and heading.

As noted above, the cold working step (Block 124) may be performed to achieve recrystallization in the aluminum starting material. Therefore, a certain minimum amount plastic deformation is required from the cold working step. In one expression, the cold working step may achieve a plastic deformation of at least about 2 percent cold work, wherein percent cold work (PCW) is calculated as follows $$PCW = \left(\frac{A_0 - A_D}{A_0}\right) \times 100$$

wherein $A_0$ is the original cross-sectional area (the cross-sectional area of the aluminum starting material) and $A_D$ is the cross-sectional area after deformation (the cross-sectional area of the aluminum cold worked material). In another expression, the cold working step may achieve a plastic deformation of about 3 to about 20 percent cold work. In yet another expression, the cold working step may achieve a plastic deformation of about 5 to about 15 percent cold work.

Thus, the cold working phase 104 may provide an aluminum cold worked material having the desired gauge. Using the aluminum cold worked material in the subsequent forming/finishing phase 106 may result in the formation of a part that is substantially free of discoloration (or at least with reduced discoloration).

The forming/finishing phase 106 of the disclosed method 100 may convert the aluminum cold worked material into a part having the desired size and shape. During the forming/finishing phase 106, the part may also undergo various surface treatments, as well as chemical and/or electrochemical processing, thereby providing a final, finished product.

Referring to FIG. 1, the forming/finishing phase 106 of the disclosed method 100 may begin at Block 126 with the step of forming the aluminum cold worked material into the desired part configuration. The forming step (Block 126) may introduce non-uniform stresses to the aluminum cold worked material to effect plastic deformation that transforms the aluminum cold worked material, which may be in plate form, into a part having the desired size and shape.

Various forming processes (or combination of forming processes) may be employed during the forming step (Block 126). As one example, the forming step (Block 126) may include spin forming. As another example, the forming step (Block 126) may include die-stamping.

Prior to, or simultaneously with, the forming step (Block 126), the aluminum cold worked material may optionally be cut into a blank having the desired silhouette. For example, when forming an aircraft lipskin, the aluminum cold worked material may first be cut into a blank having a flat, annular ring (e.g., donut) shape. Then, the donut-shaped blank may be formed (e.g., spin formed) into the desired lipskin configuration.

At Block 128, the formed part may undergo heat treatment (e.g., solution heat treatment). The heat treatment step (Block 128) may be performed at a relatively high temperature for a relatively short period of time to place into solution any soluble secondary phase particles, thereby yielding a heat treated part having the desired (recrystallized) grain structure. For example, when the formed part is 2219 aluminum alloy, the heat treatment step (Block 128) may include heating the formed part to a temperature ranging from about 975° F. to about 1015° F. for about 10 minutes to about 240 minutes. The heat treatment step (Block 128) may provide a heat treated part in the "solution heat treated" (W) temper.

The heat treatment step (Block 128) may cause some distortion to the formed part (i.e., the heat treated part may be configured slightly differently than the formed part). Therefore, as shown at Block 130, a final sizing step may be performed after the heat treatment step (Block 128), thereby providing a sized part having the desired final part configuration. The final sizing step (Block 130) may include an additional forming process, such as spin forming and/or die-stamping.

At Block 132, the sized part may undergo inspection. The inspection step (Block 132) may be non-destructive, and may look for surface imperfections, cracks, internal defects and the like. For example, the inspection step (Block 132) may be performed visually and/or with equipment, such as an ultrasound device.

At Block 134, the inspected and sized part may undergo aging. The aging step (Block 134) may be performed at a relatively low temperature for a relatively long amount of time to induce second phase precipitation and improve alloy mechanical properties. For example, when the inspected and sized part is formed from 2219 aluminum alloy, the aging step (Block 134) may include holding the inspected and sized part at a temperature ranging from about 300° F. to about 400° F. for about 16 hours to about 32 hours. The aging step (Block 134) may provide an aged part in the T6 or T8 temper, depending on the extent of deformation.

At Block 136, the aged part may optionally undergo one or more surface treatments. As one example, the surface treatment step (Block 136) may include machining the surface of the aged part. As another example, the surface treatment step (Block 136) may include sanding the surface of the aged part. For example, the surface treatment step (Block 136) may provide a surface treated part having a surface roughness (Ra) of at most about 40 microinches.

At Block 138, the surface treated part may undergo anodizing. For example, the anodizing step (Block 138) may include cleaning the surface treated part, anodizing the clean part, and the sealing the anodized part. Alternatively, or in addition to anodizing, other chemical and/or electrochemical treatments may be performed on the surface treated part.

While the forming/finishing phase 106 is presented as a series of steps 126, 128, 130, 132, 134, 136, additional (or fewer) steps may also be included in the forming/finishing phase 106 without departing from the scope of the present disclosure. Furthermore, while the steps 126, 128, 130, 132, 134, 136 of the forming/finishing phase 106 are presented in a particular succession order, some steps may be performed simultaneously with other steps and/or in a different order, without departing from the scope of the present disclosure.

Accordingly, the disclosed method 100 incorporates a cold working phase 104 between the starting material preparation phase 102 and the forming/finishing phase 106, thereby ensuring that the forming/finishing phase 106 is performed on a material having the desired (recrystallized) grain structure substantially uniformly therethrough. As such, discoloration in the finished part is substantially reduced (if not fully eliminate).

Figure 4:
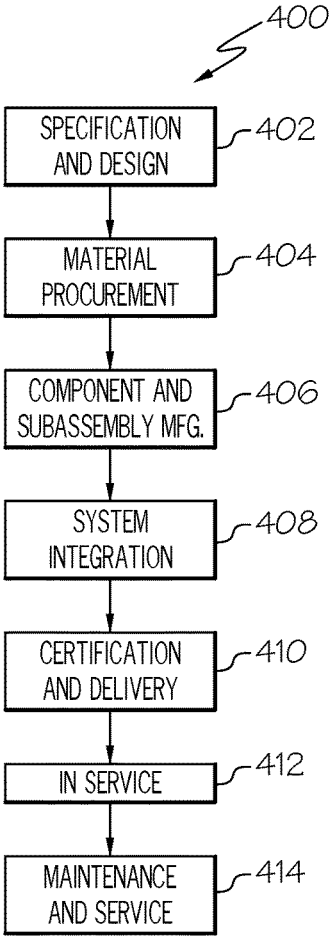
FIG. 4 is a flow diagram of an aircraft manufacturing and service methodology.
Figure 5:
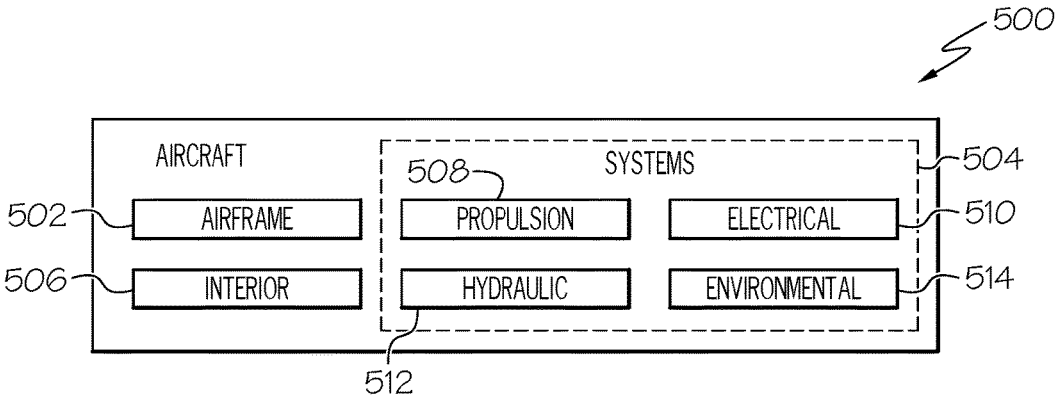
FIG. 5 is a block diagram of an aircraft.

Examples of the present disclosure may be described in the context of an aircraft manufacturing and service method 400 as shown in FIG. 4 and an aircraft 500 as shown in FIG. 5. During pre-production, the illustrative method 400 may include specification and design, as shown at block 402, of the aircraft 500 and material procurement, as shown at block 404. During production, component and subassembly manufacturing, as shown at block 406, and system integration, as shown at block 408, of the aircraft 500 may take place. Thereafter, the aircraft 500 may go through certification and delivery, as shown block 410, to be placed in service, as shown at block 412. While in service, the aircraft 500 may be scheduled for routine maintenance and service, as shown at block 414. Routine maintenance and service may include modification, reconfiguration, refurbishment, etc. of one or more systems of the aircraft 500.

Each of the processes of illustrative method 400 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 5, the aircraft 500 produced by illustrative method 400 (FIG. 4) may include airframe 502 with a plurality of high-level systems 504 and interior 506. Examples of high-level systems 504 may include one or more of propulsion system 508, electrical system 510, hydraulic system 512, and environmental system 514. Any number of other systems may be included. Although an aerospace example is shown, the principles disclosed herein may be applied to other industries, such as the automotive and marine industries. Accordingly, in addition to the aircraft 500, the principles disclosed herein may apply to other vehicles (e.g., land vehicles, marine vehicles, space vehicles, etc.).

The disclosed method 100 for manufacturing an aluminum alloy part may be employed during any one or more of the stages of the manufacturing and service method 400. For example, components or subassemblies corresponding to component and subassembly manufacturing (block 406) may be fabricated or manufactured using the disclosed method 100 for manufacturing an aluminum alloy part. Also, the disclosed method 100 for manufacturing an aluminum alloy part may be utilized during production stages (blocks 406 and 408), for example, by substantially expediting assembly of or reducing the cost of aircraft 500. Similarly, the disclosed method 100 for manufacturing an aluminum alloy part may be utilized, for example and without limitation, while aircraft 500 is in service (block 412) and/or during the maintenance and service stage (block 414).

Although various embodiments of the disclosed method for manufacturing anodized aluminum alloy parts without surface discoloration have been shown and described, modifications may occur to those skilled in the art upon reading the specification. The present application includes such modifications and is limited only by the scope of the claims.

What is claimed is:

1. A method for manufacturing a part from an aluminum starting material, the method comprising:

cold working the aluminum starting material to obtain an aluminum cold worked material;

forming the part from the aluminum cold worked material, wherein the forming includes forming the part to have a non-planar configuration;

solution heat treating the part, thereby yielding a solution heat treated part having a recrystallized grain structure; and anodizing the solution heat treated part.

2. The method of claim 1 wherein the part is an aircraft lipskin.

3. The method of claim 1 wherein the aluminum starting materiel comprises a 2xxx series aluminum alloy.

4. The method of claim 1 wherein the aluminum starting material comprises 2219 aluminum alloy.

5. The method of claim 1 wherein the aluminum starting material is in plate form.

6. The method of claim 1 wherein the cold working comprises stretching the aluminum starting material.

7. The method of claim 1 wherein the cold working comprises rolling the aluminum starting material.

8. The method of claim 1 wherein the cold working is performed at a cold working temperature, and wherein the cold working temperature is at most about 50 percent of a melting point, in degrees kelvin, of the aluminum starting material.

9. The method of claim 1 wherein the cold working is performed at a cold working temperature, and wherein the cold working temperature is at most about 300° F.

10. The method of claim 1 wherein the cold working is performed at a cold working temperature, and wherein the cold working temperature is at most about 200° F.

11. The method of claim 1 wherein the cold working is performed to achieve at least about 2 percent cold work.

12. The method of claim 1 wherein the cold working is performed to achieve about 3 percent to about 20 percent cold work.

13. The method of claim 1 wherein the cold working is performed to achieve about 5 percent to about 15 percent cold work.

14. The method of claim 1 wherein the forming comprises at least one of spin forming and die-stamping.

15. The method of claim 1 wherein the aluminum starting material includes a plurality of individual grains, and wherein the cold working results in accumulation of strain energy in the individual grains of the aluminum cold worked material.

16. The method of claim 1 wherein the solution heat treating includes heating the formed part to a temperature ranging from about 975° F. to about 1015° F.

17. The method of claim 1 wherein the solution heat treating includes heating the formed part to a temperature ranging from about 975° F. to about 1015° F. for about 10 minutes to about 240 minutes.

18. The method of claim 1 further comprising performing a sizing step after the solution heat treating.

19. The method of claim 18 wherein the sizing step includes at least one of spin forming and die-stamping.

20. The method of claim 1 further comprising preparing the aluminum starting material, the preparing the aluminum starting material comprising:

casting an ingot;

scalping the ingot to yield a scalped ingot;

homogenizing the scalped ingot to yield a homogenized ingot;

breakdown of the homogenized ingot to yield a slab;

rolling the slab to yield a rolled aluminum material;

annealing the rolled aluminum material to yield the aluminum starting material.

* * * * *